US006964606B1

(12) United States Patent
Gurule

(10) Patent No.: US 6,964,606 B1
(45) Date of Patent: Nov. 15, 2005

(54) WINDOW DUCTING SYSTEM

(76) Inventor: Grace Gurule, 2760 Los Padillas South West, Albuquerque, NM (US) 87105

( * ) Notice: Subject to any disclaimer, the term of this patent is extended or adjusted under 35 U.S.C. 154(b) by 0 days.

(21) Appl. No.: 10/918,999

(22) Filed: Aug. 16, 2004

(51) Int. Cl.[7] ..... E06B 7/02
(52) U.S. Cl. ..... 454/196; 248/208
(58) Field of Search ..... 454/196, 208, 454/200, 225; 52/204.6, 204.51

(56) References Cited

U.S. PATENT DOCUMENTS 1,587,658 A * 6/1926 Laycock ..... 160/91
2,818,793 A * 1/1958 Hord ..... 454/203
4,226,049 A * 10/1980 Maust ..... 49/57
5,195,869 A * 3/1993 Groenhoff ..... 415/213.1
5,283,975 A * 2/1994 Piterski ..... 49/50
5,582,025 A * 12/1996 Dubin et al. ..... 62/262
5,862,645 A * 1/1999 Lee ..... 52/786.11
6,579,169 B1 * 6/2003 Demark ..... 454/208

* cited by examiner

*Primary Examiner*—Derek S. Boles

(57) ABSTRACT

A window ducting system includes a window frame that has an inner perimeter as well as an outer surface and an inner surface with respect to a dwelling. Security bars are attached to the window fame and are positioned adjacent to the inner surface. An air cooling assembly is positioned adjacent to the securing bars and is positioned for directing air through the window frame. A housing has a bottom wall, a top wall, a first side wall, a second side wall and a back wall. The back wall has an opening therein. The housing is positioned in the inner perimeter of the window frame such that the back wall is positioned adjacent to the security bars and the opening is aligned with a face of the air cooling assembly.

8 Claims, 6 Drawing Sheets

WINDOW DUCTING SYSTEM

BACKGROUND OF THE INVENTION

1. Field of the Invention

The present invention relates to ducting devices and more particularly pertains to a new ducting device for ducting air from an air cooling assembly through a window that is covered with security walls.

2. Description of the Prior Art

Apparatuses used with air cooling assemblies include U.S. Pat. No. 5,425,674 which describes a cover for a swamp cooler for preventing air flow through the swamp cooler. Another similar device is U.S. Pat. No. 4,332,114 describes a cover for positioning over a window mounted air cooling assembly for completely covering the air cooling assembly. Yet another cover is shown in U.S. Pat. No. 4,389,827 which may be used for forming an air tight seal around an air cooling assembly.

While these devices fulfill their respective, particular objectives and requirements, the need remains for a device that is adapted for ducting air through a window when the window is covered with security bars. The security bars prevent the extension of an air cooling assembly into the window. The duct is required to form a seal around an opening that is aligned with a front side of the air cooling assembly. This ensures air is ducted through the window instead of being lost around the sides of the window because of the air cooling assembly being spaced from the window.

SUMMARY OF THE INVENTION

The present invention meets the needs presented above by generally comprising a window frame that has an inner perimeter and an outer surface and an inner surface with respect to a dwelling. Security bars are attached to the window fame and are positioned adjacent to the inner surface. An air cooling assembly is positioned adjacent to the securing bars and is positioned for directing air through the window frame. A housing has a bottom wall, a top wall, a first side wall, a second side wall and a back wall. The back wall has an opening therein. The housing is positioned in the inner perimeter of the window frame such that the back wall is positioned adjacent to the security bars and the opening is aligned with a face of the air cooling assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
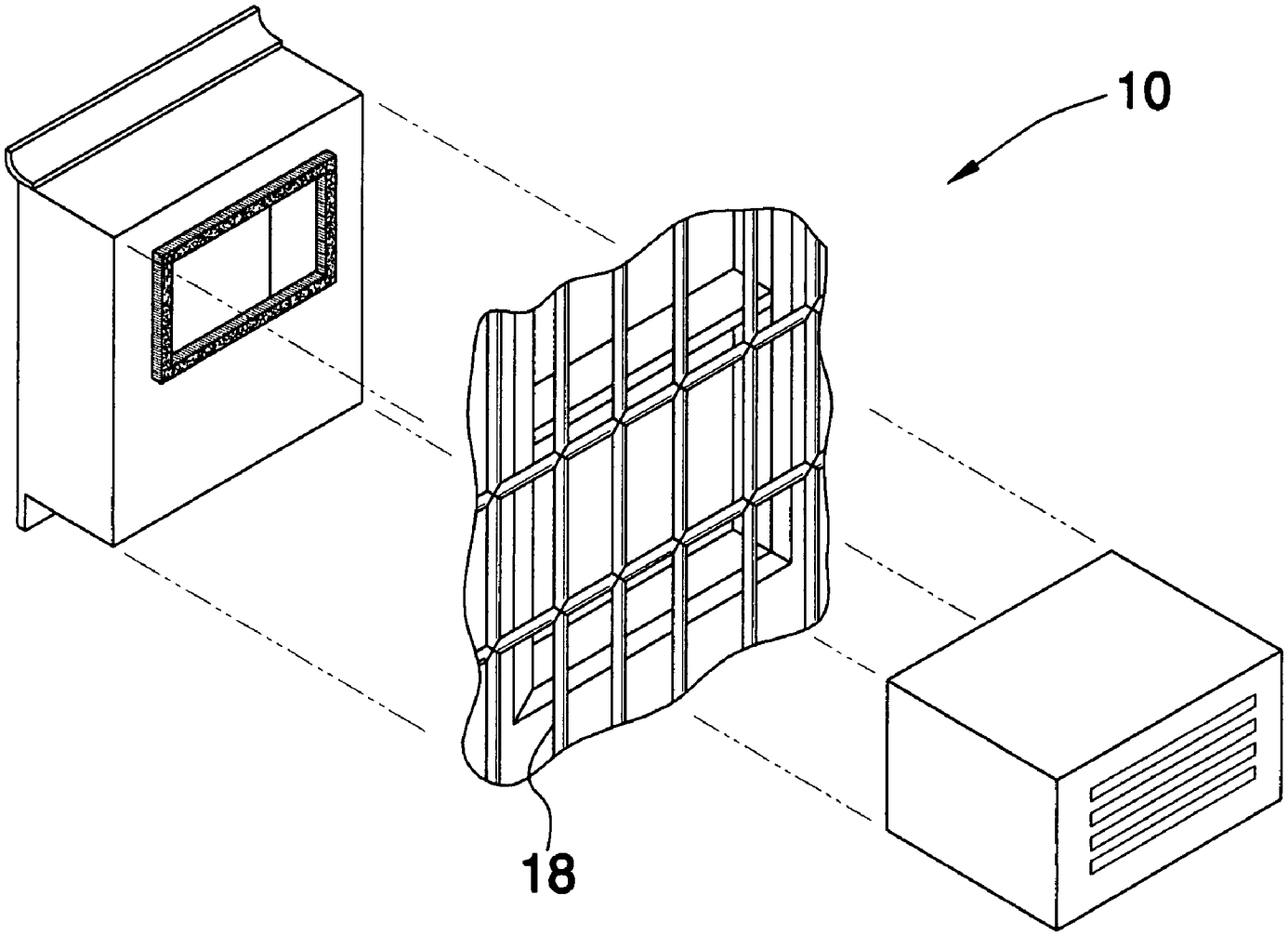
FIG. 1 is a schematic perspective rear view of a window ducting system according to the present invention.
Figure 2:
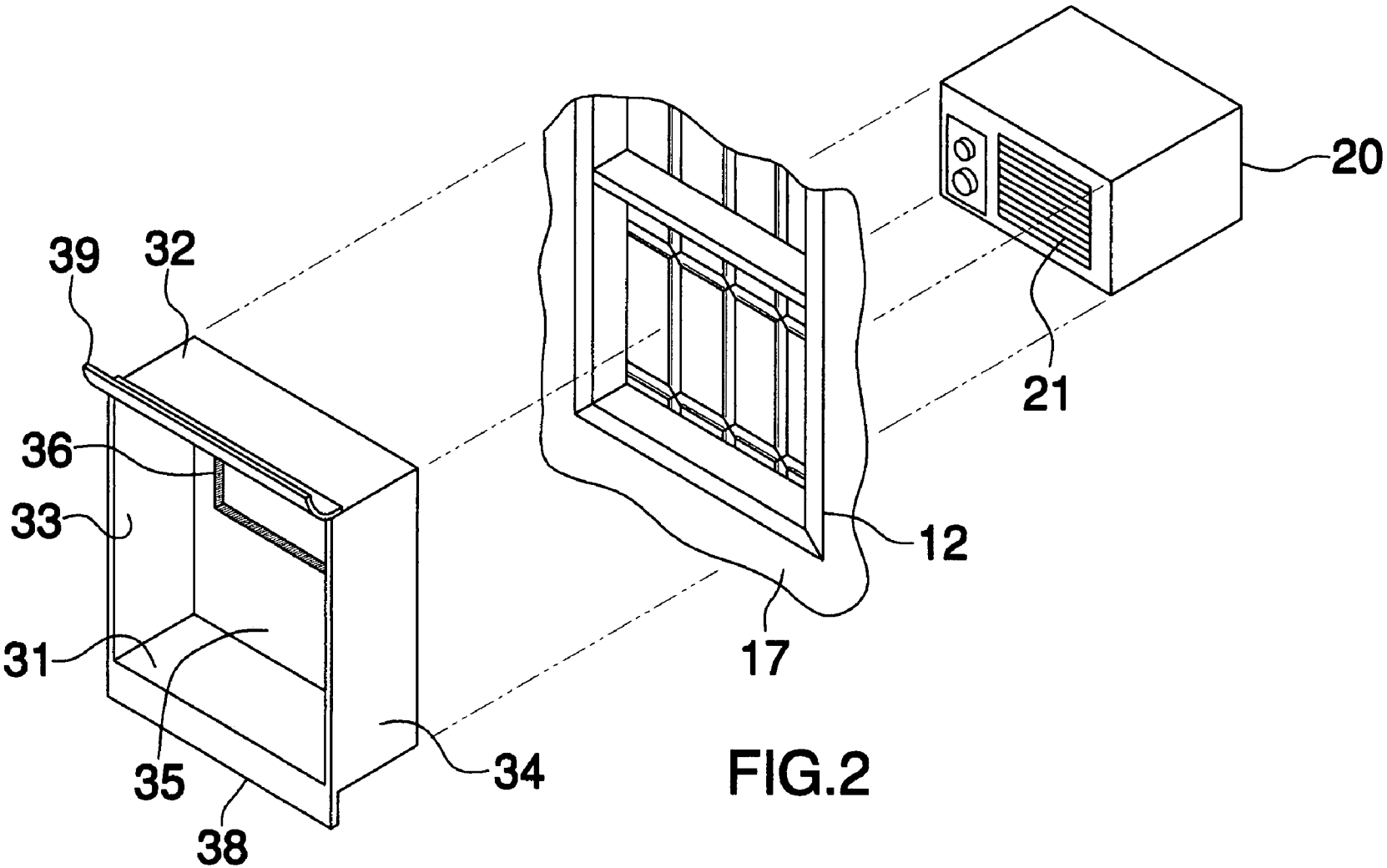
FIG. 2 is a schematic perspective front view of the present invention.
Figure 3:
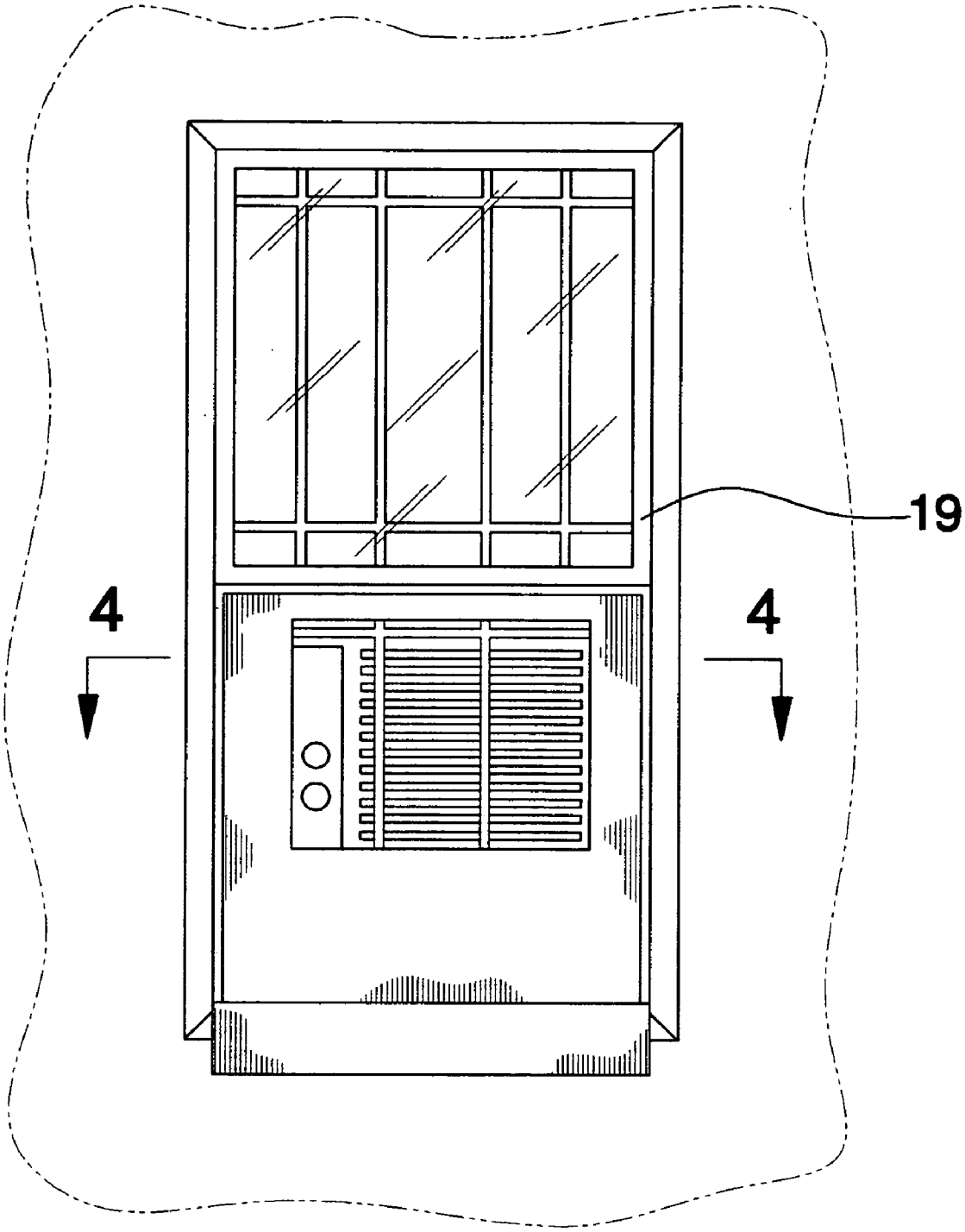
FIG. 3 is a schematic front view of the present invention.
Figure 4:
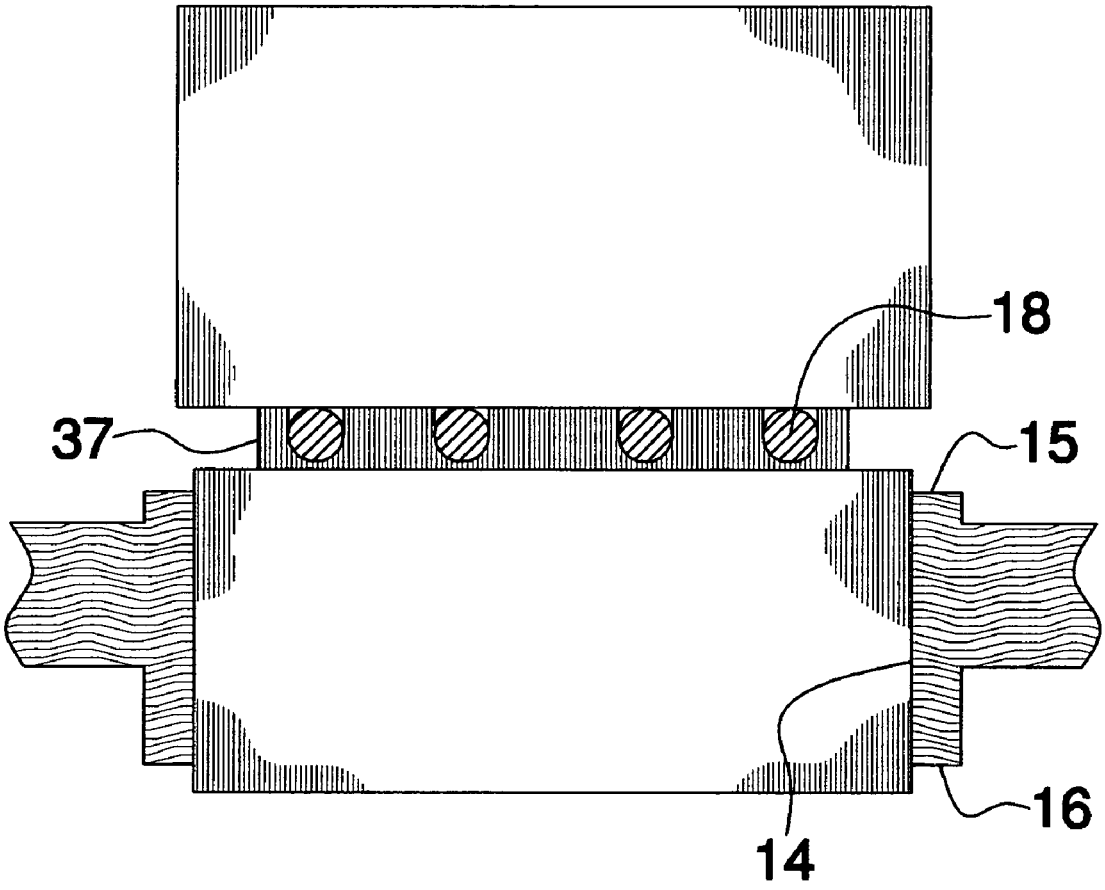
FIG. 4 is a schematic top view taken along line 4—4 of FIG. 3 of the present invention.
Figure 5:
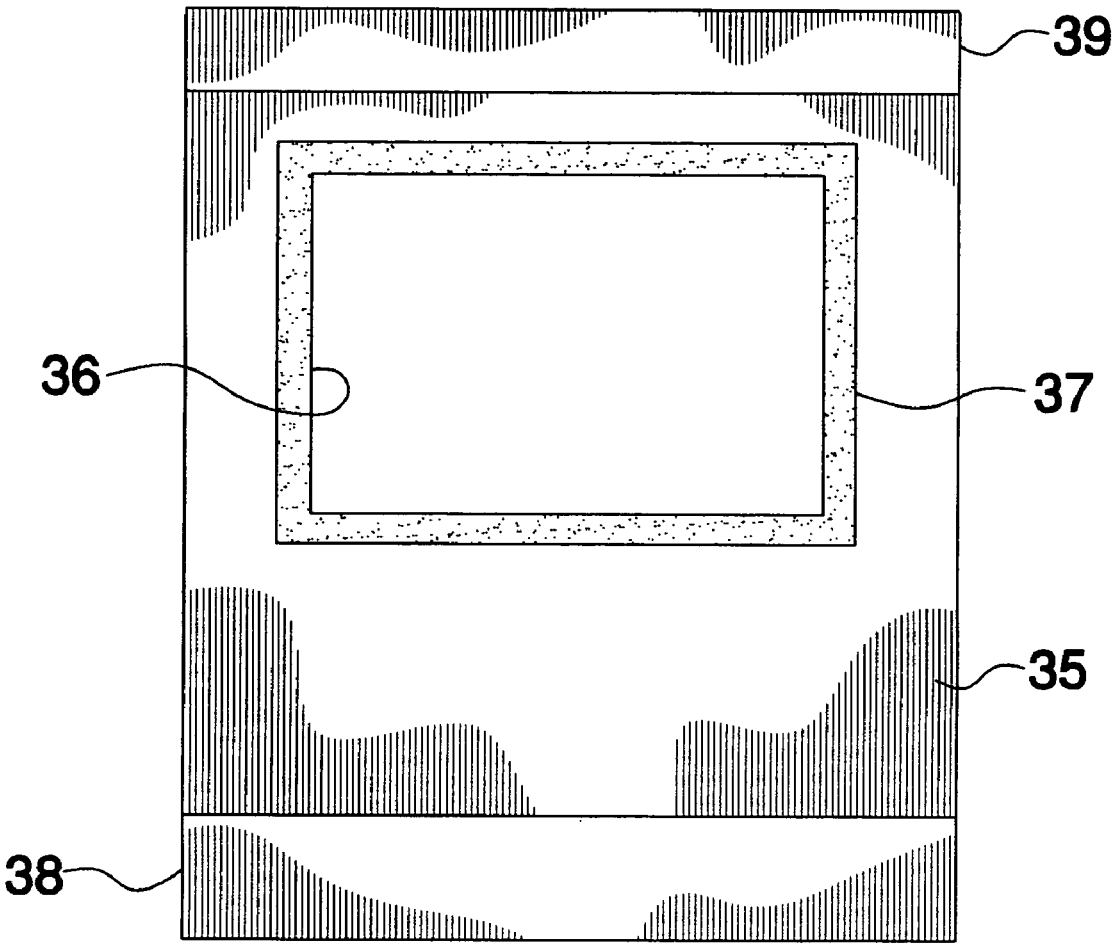
FIG. 5 is a schematic rear view of the present invention.
Figure 6:
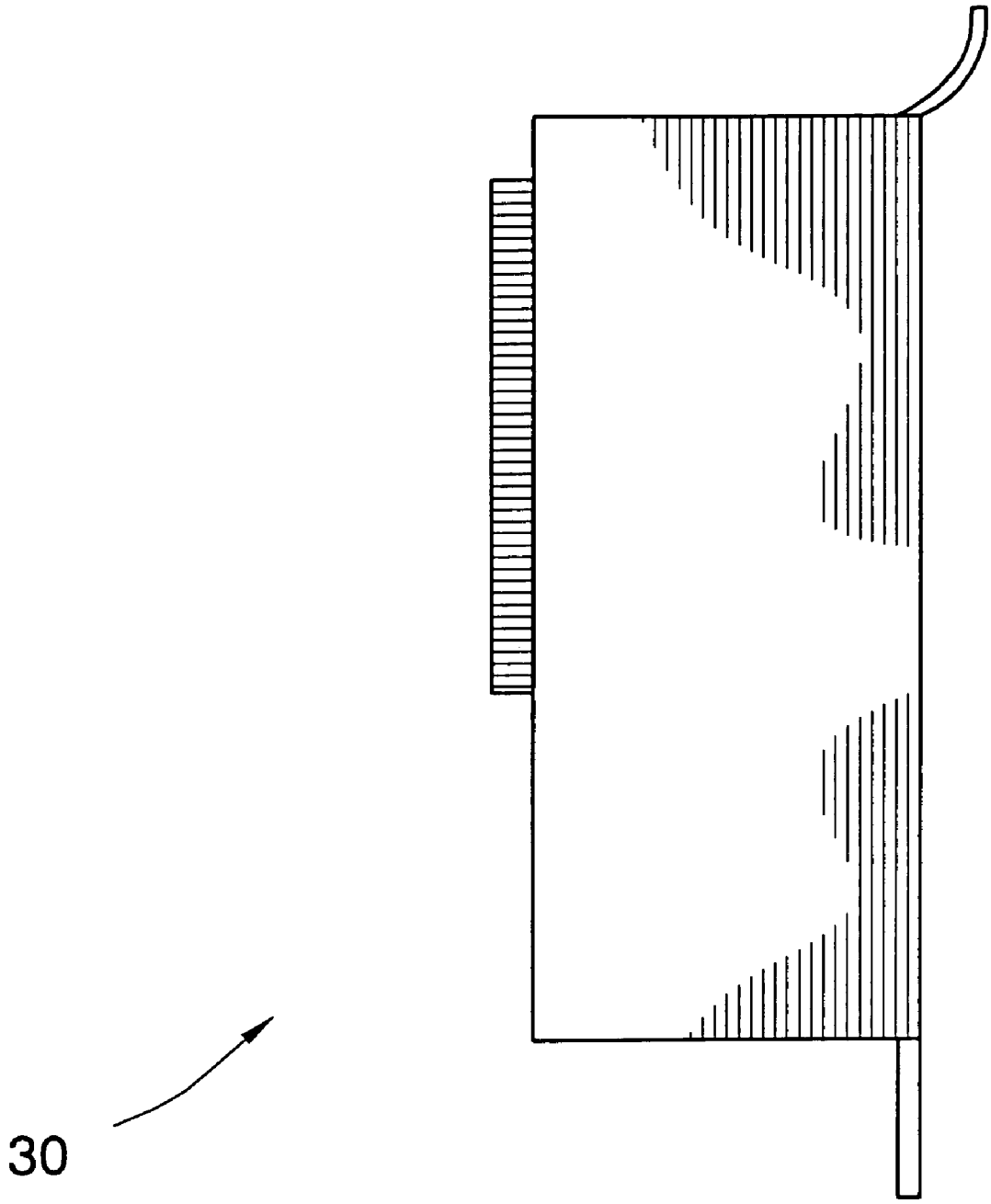
FIG. 6 is a schematic side view of the present invention.

With reference now to the drawings, and in particular to FIGS. 1 through 6 thereof, a new ducting device embodying the principles and concepts of the present invention and generally designated by the reference numeral 10 will be described.

As best illustrated in FIGS. 1 through 6, the window ducting system 10 generally comprises a device for use in a window frame 12 that has an inner perimeter 14. The window frame 12 has an outer surface 15 and inner surface 16 with respect to a dwelling 17. Security bars 18 are attached to the window fame 12 and are positioned adjacent to the inner surface 16.

An air cooling assembly 20 is positioned adjacent to the securing bars 18 and is positioned for directing air through the window frame 12. The air cooling assembly 20 may include a window mounted air conditioner or a window mounted swamp cooler. The system 10 is particularly useful with swamp coolers because a majority of their volume must be kept outside due to their dependence on a water source.

A housing 30 is provided that has a bottom wall 31, a top wall 32, a first side wall 33, a second side wall 34 and a back wall 35. The back wall 35 has an opening 36 therein. The housing 30 has a depth from a front peripheral edge to the back wall 35 generally between 4 inches and 12 inches, a height generally between 20 inches and 30 inches, and a width generally between 20 inches and 30 inches. The opening 36 has a size and shape substantially equal to a face 21 of the air cooling assembly 20. The face 21 is defined as the area bound by the controls and ducts of the air cooling assembly 20. A plurality of bristles 37 is attached to and extends away from the back side 35. The bristles 37 are positioned adjacent against and extend around a peripheral edge of the opening 36. A flange 38 is attached to and extends along an edge of the bottom wall 35. The flange 38 extends downward from the bottom wall 31. A lip 39 is attached to and extends along an edge of the top wall 32. The lip 39 is arcuate and extends outwardly and upwardly from the top wall 32.

In use, the housing 30 is positioned in the inner perimeter 14 of the window frame 12 so that the back wall 35 is positioned adjacent to the security bars 18 and the opening 36 is aligned with the face 21 of the air cooling assembly 20. The housing 30 has a size adapted to simultaneously abut the lateral and bottom sides of the window frame 12. A top window 19 of the frame 12 is lowered onto the housing 30. The bristles 37 extend around the bars 18 and abut a front side of the air cooling assembly 20. The bristles 37 extend around its face 21 and prevent insects from entering through the window frame 12 and also prevents the loss of air being blown by the air cooling assembly 20. The flange 38 stabilizes the housing 30 in the window 12 and the lip 38 prevents water from running along the top wall 32 and into the housing 30. The top wall 32 may also be angled down from the flange 39 to the back wall 35 for the same reason.

The housing 30 ensures that the air is properly directed into a dwelling while retaining the security of the security bars 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of ducting air through a window comprising the steps of:

providing a window frame having an inner perimeter, said window frame having an outer surface and inner surface with respect to a dwelling, security bars being attached to said window fame and being positioned adjacent to said inner surface;

providing an air cooling assembly being positioned adjacent to the securing bars and being positioned for directing air through the window frame;

providing a housing having a bottom wall, a top wall, a first side wall, a second side wall and a back wall, said back wall having an opening therein; and positioning said housing in said inner perimeter of said window frame such that said back wall is positioned adjacent to said security bars and said opening is aligned with a front side of said air cooling assembly.

2. The method according to claim 1, wherein said housing has a depth from a front peripheral edge to said back wall generally between 4 inches and 12 inches, said housing having a height generally between 20 inches and 30 inches, said housing having a width generally between 20 inches and 30 inches, said opening having a size and shape substantially equal to a face of said air cooling assembly.

3. The method according to claim 1, further providing a plurality of bristles being attached to and extending away from said back side, said bristles being positioned adjacent against and extending around a peripheral edge of said opening.

4. The method according to claim 1, further providing a flange being attached to and extending along an edge of said bottom wall, said flange extending downward from said bottom wall.

5. The method according to claim 4, further providing a lip being attached to and extending along an edge of said top wall, said lip being arcuate and extending outwardly and upwardly from said top wall.

6. The method according to claim 1, further providing a lip being attached to and extending along an edge of said top wall, said lip being arcuate and extending outwardly and upwardly from said top wall.

7. The method according to claim 5, further providing a plurality of bristles being attached to and extending away from said back side, said bristles being positioned adjacent against and extending around a peripheral edge of said opening.

8. A method of ducting air through a window comprising the steps of:

providing a window frame having an inner perimeter, said window frame having an outer surface and inner surface with respect to a dwelling, security bars being attached to said window fame and being positioned adjacent to said inner surface;

providing an air cooling assembly being positioned adjacent to the securing bars and being positioned for directing air through the window frame;

providing a housing having a bottom wall, a top wall, a first side wall, a second side wall and a back wall, said back wall having an opening therein, said housing having a depth from a front peripheral edge to said back wall generally between 4 inches and 12 inches, said housing having a height generally between 20 inches and 30 inches, said housing having a width generally between 20 inches and 30 inches, said opening having a size and shape substantially equal to a face of said air cooling assembly;

providing a plurality of bristles being attached to and extending away from said back side, said bristles being positioned adjacent against and extending around a peripheral edge of said opening;

providing a flange being attached to and extending along an edge of said bottom wall, said flange extending downward from said bottom wall;

providing a lip being attached to and extending along an edge of said top wall, said lip being arcuate and extending outwardly and upwardly from said top wall; and positioning said housing in said inner perimeter of said window frame such that said back wall is positioned adjacent to said security bars and said opening is aligned with said face of said air cooling assembly.

* * * * *